US005609076A

United States Patent [19]

Idland

[11] Patent Number: 5,609,076

[45] Date of Patent: Mar. 11, 1997

[54] CONTAINER OPENER

[76] Inventor: Carsten Idland, 3526 Centinela Ave., #8, Los Angeles, Calif. 90066

[21] Appl. No.: 526,684

[22] Filed: Sep. 11, 1995

[51] Int. Cl.[6] ..... B67B 7/16

[52] U.S. Cl. ..... 81/3.57; 81/3.43; 81/64

[58] Field of Search ..... D8/395, 499; 81/3.4, 81/3.43, 3.55, 3.57, 64, 65.2, 68

[56] References Cited

U.S. PATENT DOCUMENTS

D. 292,144 10/1987 McClure .

4,171,652 10/1979 Curry ..... 81/3.43 X

OTHER PUBLICATIONS

Johnson Smith Co. Catalog, 1985, p. 52, upper left of page.

New York Times Magazine, Apr. 27, 1975, upper center of p. 76.

*Primary Examiner*—James G. Smith

*Attorney, Agent, or Firm*—William W. Haefliger

[57] ABSTRACT

A chain link device to remove a cap from a container, comprising a chain having a series of links interconnected at pivot locations; the chain having a first looping portion sized to grip a bottle cap; and the chain having a second handle portion projecting away from the looping portion for grasping to exert prying leverage on the first portion.

9 Claims, 1 Drawing Sheet

CONTAINER OPENER

BACKGROUND OF THE INVENTION

This invention relates generally to devices to remove caps from containers, and more particularly to a novel chain type device configured to grip and remove standard bottle type caps from bottles.

There is need for a single, rugged, easily used device manually operable to grip and apply leverage to bottle caps, for easily removing them from containers such as bottles.

SUMMARY OF THE INVENTION

It is a major object of the invention to provide an improved novel cap remover of great strength and easily usable. Basically, the device comprises:

a) a chain having a series of links interconnected at pivot locations, b) the chain having a first looping portion sized to grip a bottle cap, c) the chain having a second handle portion projecting away from the looping portion for grasping to exert prying leverage on the first portion.

As will appear, the chain typically extends in a predetermined plane, there being pivots at locations defining axes all of which are normal to the plane; and the pivots typically comprise rivets holding together portions of successive links, at the locations.

Yet another object is to provide the chain handle portion to comprise two segments of the chain, the segments including links having edges which interfit along an undulating path. The handle portion typically has a length between 1.5 and 4 inches; and the chain has a succession of side links the number of which at said handle portion and at each side of the chain is between 4 and 6.

On an overall basis, the chain typically has a succession of side links the number of which, at each side of the chain is between 6 and 9.

These and other objects and advantages of the invention, as well as the details of an illustrative embodiment, will be more fully understood from the following specification and drawings, in which:

DRAWING DESCRIPTION

DETAILED DESCRIPTION

Figure 1:
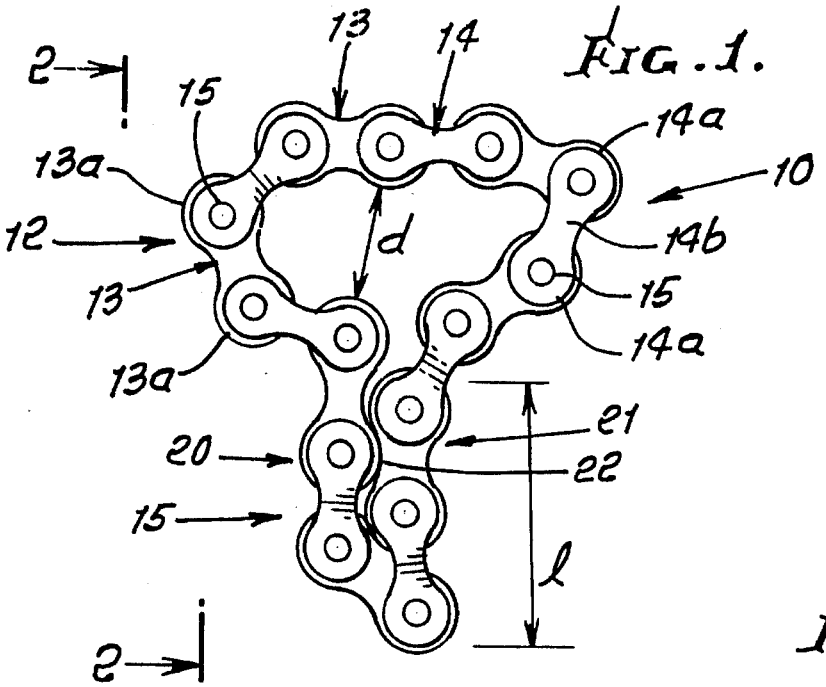
FIG. 1 is a plan view of a chain link bottle opener.
Figure 2:
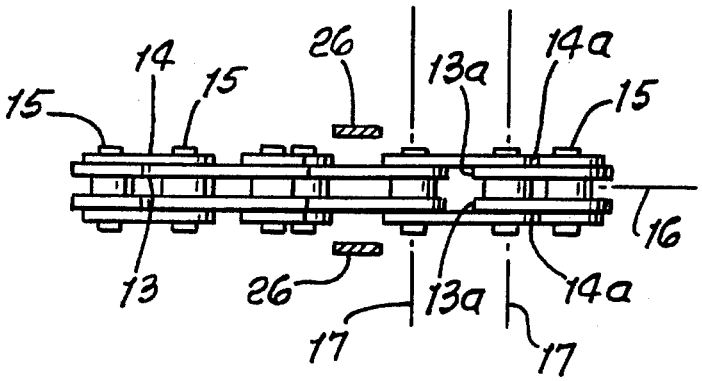
FIG. 2 is a side elevation view taken on lines 2—2 of FIG. 1.

In FIG. 1, a chain link device 10 is configured to remove a cap from a container, such as a bottle. Thus, the cap, indicated at 11 in FIG. 3, may comprise a standard bottle cap, as on a soft drink bottle. The circular cap has a top 11*a* and a skirt 11*b* to be gripped by the looping portion 12 of the device 10, and typically by the curved edges of the hubs 13*a* of the intermediate chain links 13. The latter interconnect side links 14, located in pairs, as shown. Rivets 15 typically interconnect the hubs 14*a* of the side links and hubs 13*a* of the intermediate links, as seen in FIG. 2. The skirt gripping inner boundary of the loop has a diameter "d" of about 1 inch.

Figure 3:
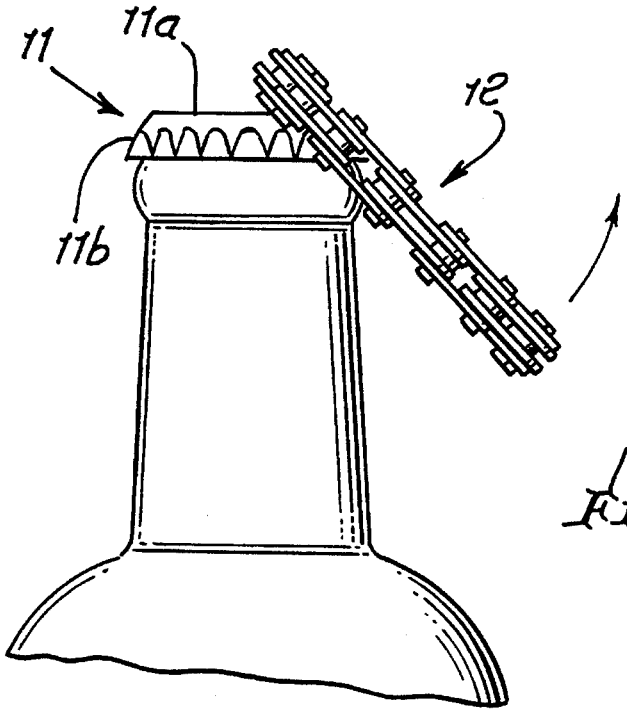
FIG. 3 shows the opener in cap removal position.

The chain first looping portion 12 is therefore sized to grip the bottle cap skirt over which the portion looping portion 12 fits as seen in FIG. 3, showing portion 12 tilted relative to the axis of the cap, as it grips the skirt, for removing the cap.

The chain has a second portion 30 in the form of a handle projecting away from the looping portions, to be manually grasped to exert prying leverage on the looping first portion 12, to tilt it as referred to. The portions 12 and 30 extend in the same plane, as for example the plane indicated at 16 in FIG. 2, so that the axes of the rivets (see axes 17) are normal to the plane 16.

The handle portion 15 of the chain has a length "l" between 1.5 and 4 inches, so that it can be grasped to exert cap removing leverage on looping portion 12. The handle portion includes two segments 20 and 21 of the chain, those segments including links having edges which interfit along an undulating path indicated at 22. Thus, hubs 13*a* of intermediate links of each of the two segments have convex edges that interfit concave edges of narrowed middle portions 13*b* of the intermediate links of the other of the two segments, as shown, to define the path 22. Means may be provided to retain the segments 20 and 21 in such position, as for example a clip, which may be removable. Portions of such a clip are shown at 26. Other retention means maybe provided.

Narrowed middle portions of the outer or side links, appear at 14*b*, located between hubs 14*a*. The total number of links at each side of the chain is typically between 6 and 8, and preferably is 7, as shown. The total number of side links at each side of the chain, and on the segments 20 and 21, is between 4 and 6, and preferably is 4.

I claim:

1. A chain link device to remove a cap from a container, comprising:

a) a chain having a series of links interconnected at pivot locations, b) the chain having a first looping portion sized to grip a bottle cap, c) the chain having a second handle portion projecting away from the looping portion for grasping to exert prying leverage on said first portion, d) the chain having adjacent chain segments which interfit at said handle portion, e) and including a clip retaining said segments in adjacent relation.

2. The device of claim 1 wherein the chain extends in a predetermined plane, there being pivots at said locations defining axes all of which are normal to said plane.

3. The device of claim 2 wherein the pivots comprise rivets holding together portions of successive links, at said locations.

4. The device of claim 1 wherein said loop defines a cap engaging boundary having a cross dimension of about one inch.

5. The device of claim 1 wherein said handle portion has a length between 1.5 and 4 inches.

6. The device of claim 1 wherein the chain has a succession of side links the number of which, at each side of the chain is between 6 and 9.

7. The device of claim 1 wherein the chain has a succession of side links the number of which at each side of the chain is 7.

8. The device of claim 1 wherein the chain has a succession of side links, the number of which at said handle portion and at each side of the chain is between 4 and 6.

9. The device of claim 1 wherein the handle portion includes two segments of the chain, said segments including links having edges which interfit along an undulating path.

* * * * *